United States Patent [19]

Maestri

[11] 4,194,665

[45] Mar. 25, 1980

[54] PNEUMATIC STAPLER

[76] Inventor: Giordano B. Maestri, 26, Via Foppa, Milano, Italy

[21] Appl. No.: 873,928

[22] Filed: Jan. 31, 1978

[30] Foreign Application Priority Data

Feb. 10, 1977 [IT] Italy ..... 20146 A/77

[51] Int. Cl.[2] ..... B25C 5/06

[52] U.S. Cl. ..... 227/112; 227/130; 327/138

[58] Field of Search ..... 227/112, 130, 138, 113

[56] References Cited

U.S. PATENT DOCUMENTS

| | | | |
|---|---|---|---|
| 2,445,674 | 7/1948 | Kendall | 227/112 |
| 2,707,277 | 5/1955 | Aldrich | 227/112 |
| 2,829,369 | 4/1958 | Browning | 227/113 |
| 2,923,937 | 2/1960 | Laucher | 227/112 |
| 2,931,038 | 4/1960 | Wandel | 227/112 |
| 3,348,291 | 10/1967 | Niedzwiecki | 227/112 |
| 3,488,825 | 1/1970 | Lundgren | 227/112 |
| 3,713,573 | 1/1973 | Fehrs | 227/130 |

*Primary Examiner*—John McQuade
*Attorney, Agent, or Firm*—Michael J. Striker

[57] ABSTRACT

A pneumatic stapler includes a housing having an elongated guiding passage for guiding a staple to be struck, a pneumatically operated stapling hammer for striking the staple located in the guiding passage and an elongated hollow staple magazine for connected separate staples. The magazine has a first end open into the guiding passage and a second end spaced from the first end along the elongation of the magazine. The staples are displaced along the magazine towards the first end thereof by air pressure supplied through a pneumatic nozzle connection located in the magazine between the first and second ends thereof. A spring pawl prevents movement of the staples located upstream of the nozzle connection towards the second end of the magazine.

9 Claims, 4 Drawing Figures

42
34
44
46
A
32
30
38
40
III
36
30a
28
14
10
12
32a
A'
II
20
18
48
50
16
24
22
26

PNEUMATIC STAPLER

BACKGROUND OF THE INVENTION (1) The Field of the Invention

The present invention relates to a pressurized air operated nailing or stapling device and, more particularly, to a mechanism designed for sequentially driving into wooden workpieces (such as pieces of furniture, for example) large headed staples. The mechanism comprises a pressurized air operated cylinder and a reciprocating piston connected to a driver hammer rod which operates into a guide passage. An elongate staple magazine is provided with a plurality of large headed staples which is positioned prior to service. The individual staples are sequentially moved into the said guide passage.

The device of the invention is generally designed for sequentially driving large headed nails such as tacks (e.g., of the type having a large dome-shaped head and a relatively short stem) adapted for nailing upholstery to pieces of furniture. More particularly the device is designed for sequentially driving staple-type nails each having a relatively large dome-shaped head and two parallel stems or shanks integrally connected to said head at two diametrally opposite portions thereof.

(2) The Prior Art

The automatic nailing and stapling devices are well known in the art. The supply of nails or staples to be automatically and sequentially driven is generally located into an elongated straight magazine or in a cartridge. Said magazine comprises a pair of supporting surfaces for slidably supporting the opposite portions of the nail or staple heads, and a center groove along which the shanks are aligned.

A relatively great number of simple U-shaped staples (such as those used for stapling papers together can be slidably received in a rather short magazine. The plurality of staples is biased generally by spring means along the magazine towards the guide passage for individually driving the staples one after another.

On the other hand, if large headed nails or staples are to be supplied for sequential driving, several problems have been heretofore presented. The diametral dimension of the staple heads causes provision of a substantially long magazine for accommodating therein an adequate number of staples for use between any re-loading operations. This feature leads to provision of a non-straight magazine. The nailing or stapling machines of the type are considered generally portable tools and must be adapted for use in different positions and directions. Therefore the weight or gravity cannot be relied upon for providing the regular progress of the staples along the magazine towards the operational location. According to a known arrangement (see U.S. Pat. No. 3,826,419), the supply comprises a string of ribbon-connected nails or staples which can be step-by-step pulled (instead of being pushed) towards the driving location by means of an index pawl or other suitable feed claw mechanisms acting on the nail or staple which is adjacent (or very near) to the guide passage in which the driver hammer operates. Such arrangement has, several shortcomings, such as, for example: the supplies of ribbon-connected staples must be custom made (generally by the stapler machine manufacturer) for the specific machine, packaged and delivered to the costumer, via the regular commercial channels and therefore such supplies, when available, are unavoidably a great deal more expensive than the conventional staples sold in bulk. The ribbon for interconnecting the staples is expensive and usually constitutes a waste. Further, a certain amount of energy is necessary for the step-by-step shearing the ribbon of the ribbon mounted staple, which results therefore in additional pressurized air consumption. In order to obtain sufficient stapling results there have to be provided, powerful and heavy automatic stapling machines.

SUMMARY OF THE INVENTION

It is therefore an object of this invention to provide a new and improved pressurized air fed stapling (or nailing) device in particular a portable machine which is not subject to the above and other disadvantages.

More particularly, it is an object of this invention to provide a device or machine comprising an elongated magazine, that is a magazine wherein an adequate number of large headed staples (or nails) can be simultaneously loaded for delivering the staples individually onto surfaces to be stapled.

Specifically, it is an object of the invention to provide a stapling (on nailing) machine as above defined, comprising an elongated C-cross sectionally shaped magazine and means for step-by-step applying to the large headed staples, slidably located into said magazine, a biasing force directed to facilitate the stepped progression of said staples towards the machine guide passage. The said biasing force is provided by promoting a pulsing jet or stream of pressurized air in a proper location in the said magazine directed so as to guide the staples in a direction along said guide passage.

The pulsing jets are developed by discharging air from the machine actuated cylinder during the feed stroke or return stroke of a piston. Thus, the present device is operative to use the energy of the exhaust, which is usually wasted.

According to a preferred embodiment of the present invention, the machine is further provided with retaining means designed for retaining each individual staple which has been progressed to and located in the guide passage. Said retaining means comprise a permanent magnet located adjacent to said passage.

A preferred practical embodiment of the invention is illustrated in the accompanying drawings.

DESCRIPTION OF THE PREFERRED EMBODIMENTS

Figures 1, 1A, 2, 3:
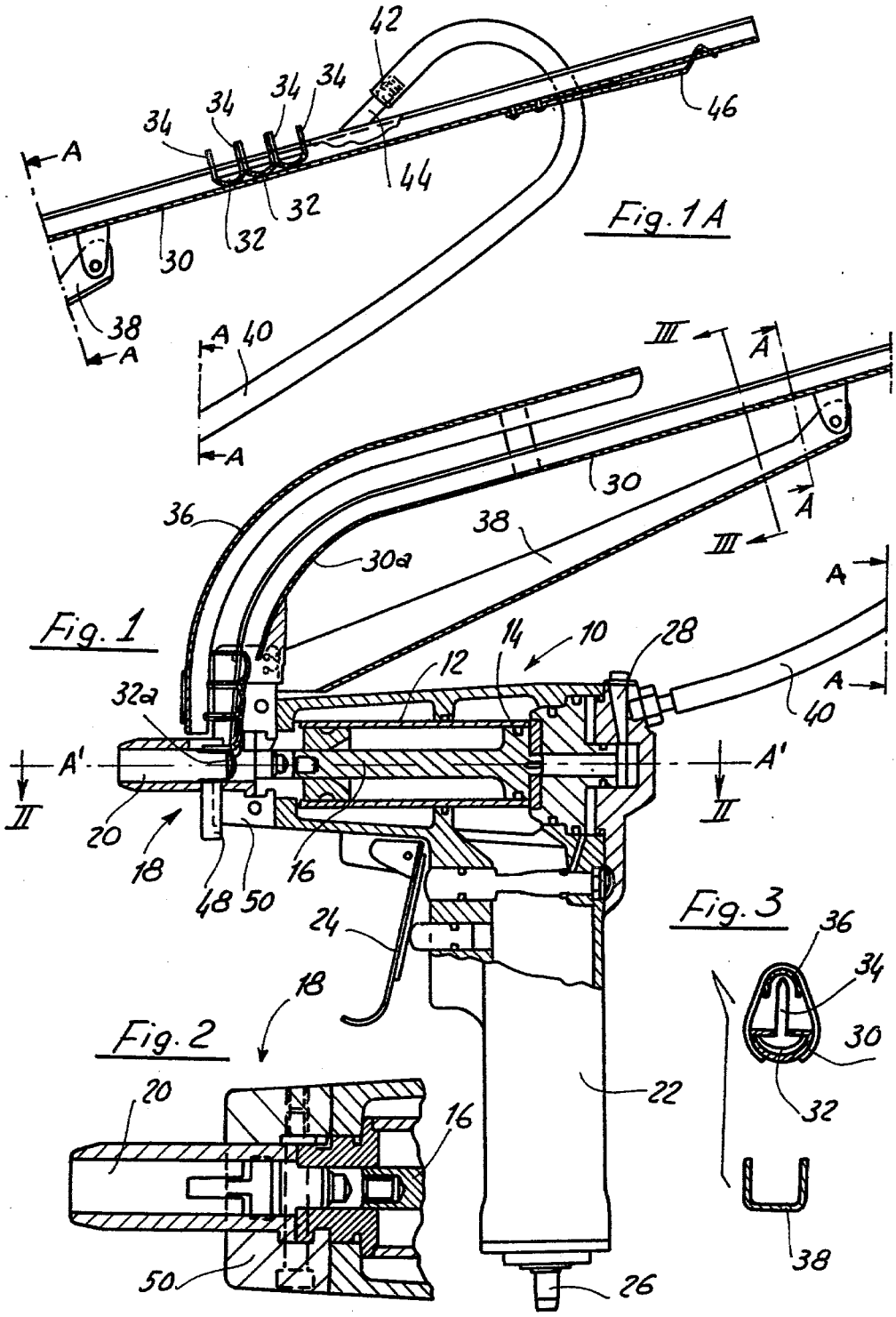
FIG. 1 is a longitudinal fragmentary sectional view of the machine including a part of the elongated magazine.
FIG. 1A is a similar view of the remaining part of the magazine, the parts of FIG. 1 and of FIG. 1A are to be considered as joined at the line indicated at A—A in FIGS. 1 and 1A.
FIG. 2 is a fragmentary sectional view, taken along the line II—II in FIG. 1
FIG. 3 is a cross-sectional view, taken along the line III—III in FIG. 1.

Referring now to the drawings, the device comprises a supporting member including a pressurized air fed motor arranged into a motor housing generally indicated by the reference numeral 10 and comprising a cylinder 12 with a reciprocatable piston 14. The piston 14 is secured to a piston shaft or stem 16. An end portion (i.e., the one which is opposite to the piston) of the shaft 16 acts in the chuck guide 18 in which the driver hammer is slidably arranged to operate into a guide passage 20. Individual staples are driven off along the guide passage 20.

The housing 10 is fixedly secured to a handle 22 which conventionally extends at a right angle relative to the motor housing. The device is further provided with a trigger lever 24 which is actuated by an operator. The trigger lever 24 is connected to conventional valve means for supplying pressurized air into the cylinder 12 for urging leftwardly (see FIG. 1) the piston 14 and drive hammer. The pressurized air is supplied through an air hose having an outlet pipe connection 26. The hose is connected to a suitable source of pressurized air (not shown). This mechanism and the means by which it is operated and triggered for applying a powerful blow to the driver hammer will not be further described in detail, since it is per se well known. The mechanism also comprises a cylinder outlet passage 28 through which the air is usually exhausted. The outlet passage 28 is tapped and communicates with one end portion of an exhaust hose 40 to be described in detail later. Having struck the staple in the guide passage 20, the piston 14 is then returned to a retracted position. The air remaining in a chamber behind the piston 14 is displaced by such movement of the piston 14 and flows through the passage 28 (which is closed from the exterior by a plug—see FIG. 1) into the exhaust hose 40.

The device is also provided with an elongated somewhat tubular magazine 30 adapted for slidably guiding a plurality of gimp nails, preferably two-stemmed large-headed staples, each having an essentially dome-shaped head 32 and two parallel pointed shanks 34. A few of such staples are shown in FIG. 1A and one staple is illustrated in FIG. 3.

The magazine 30 has a uniform C-shaped cross-section (FIG. 3). The outlet elongated portion 30*a* of the magazine 30 (FIG. 1) has a shelter 36 secured thereto for sheltering the sharpened shanks 34. A support brace 38 supports the magazine 30 relatively to the device chuck member 18.

As illustrated in FIG. 1A, the end portion 42 of the exhaust hose 40 is connected at 44 to the magazine 30 at an angle sufficient for applying air bursts or jets which are issued from said connection 44 to the adjacent staples 32, 34. Such a biasing force urges these staples towards the guide passage 20 in the chuck 18 of the device.

Thus, while the motor is in operation a force or thrust is applied to the staples in the magazine so as to ensure that the staples move towards the driving off mechanism.

The staples are freely slidable along the magazine 30, and the device (which is a portable tool) can be positioned in various directions for service. The outer or free end portion of the magazine (FIG. 1A) can be turned downwardly. Therefore, the device is advantageously provided with a spring biased pawl 46 for preventing the return motion of the staples.

Further, the sequential forces applied by the air jets at the connection 40 provide that the front staple (i.e., the staple 32*a* in FIG. 1) will reach the proper position in the chuck 18 for being driven off. On the other hand such position of the staple 32*a* is reached just after onestaple (a previous one) is discharged (i.e. in response to a forward stroke of the piston) by the urging of the exhausting jet concurrently the return stroke of the piston. Now, the staple 32*a* remains in such position until the device will be triggered again for a next shot. The staple 32*a* might for example fall down through the guide passage 20, if not properly retained.

Therefore, the device is further advantageously provided with a retaining means preferably consisting of a small magnet 48 which magnetically retains the staple 32*a* until the next blow of the hammer 16 occurs.

An automatic tool must be provided with a magazine of such a length so as to accommodate a corresponding number of staples. Such elongated magazine due to its space consumption may lead to a certain discomfort during use. Therefore, the chuck 18 is maybe rotatably connected to the housing 10 for rotation about the axis A'—A' of the chuck, by means of a collar 50, as illustrated in FIG. 2. Therefore, the magazine 30 can be differently positioned, about the said axis A'—A', relatively to the handle 22.

I claim:

1. A pneumatic stapler, comprising a housing having an elongated guiding passage for guiding a staple to be struck along said passage; a pneumatically operated stapling hammer for striking the staple located in said guiding passage; and elongated hollow staple magazine for unconnected separate staples, having a first end open into said guiding passage and a second end spaced from said first end along the elongation of said magazine; pneumatically operated means for displacing the staples towards said first end of said magazine, including a pneumatic nozzle connection located on said magazine between said first and second ends thereof and a hose for applying air pressure to the pneumatic nozzle connection when the stapling hammer is operated, at least some of said separate staples which are located in said magazine upstream of said nozzle connection tending to move towards said second end of said magazine under the force of gravity when said magazine is inclined so that said first end of the magazine is higher than said second end thereof; and a spring pawl in said magazine located upstream of said nozzle connection, for preventing movement of said some staples towards said second end of said magazine.

2. A stapler as defined in claim 1, and further comprising a cylinder-piston system having a cylinder and a piston constituted by said stapling hammer and movable within said cylinder along a longitudinal axis between a first position in which it strikes the staple located in said guiding passage and a second retracted position away from said guiding passage.

3. A stapler as defined in claim 2, and further comprising pressurized air supply means including first means for supplying air pressure in said cylinder piston system and second means for supplying air pressure in said staples displacing means for displacing the staples towards said first end of said magazine so as to advance the next successive staple into said guiding passage in a position to be struck by said stapling hammer.

4. A stapler as defined in claim 3, wherein said second air supplying means include said hose connecting said cylinder-piston system with said nozzle connection so that when said piston moves from said first position into said second retracted position air pressure is supplied through said hose and said nozzle connection into said magazine to thereby displace the staples downstream of said nozzle connection towards said first end of said magazine.

5. A stapler as defined in claim 4, and further comprising pressurized air control valve triggering means for so operating said first air pressure supplying means as to move said piston from said second retracted position into said first position for striking the next successive staple located in said guiding passage.

6. A stapler as defined in claim 2, wherein said housing is provided with a front insert rotatable about said axis.

7. A stapler as defined in claim 6, wherein said staple magazine is mounted on said insert for rotation therewith, so that said insert and said staple magazine can be arranged at any angle relative to said axis and to said housing.

8. A stapler as defined in claim 1; and further comprising staple retaining means for retaining the staple located in said guiding passage in a position ready to be struck by said stapling hammer.

9. A stapler as defined in claim 8, wherein said retaining means include a permanent magnet located in said guiding passage adjacent to said first end of said magazine.

* * * * *